US008182163B2

(12) United States Patent
Kuo et al.

(10) Patent No.: US 8,182,163 B2
(45) Date of Patent: May 22, 2012

(54) LABEL ROLL POSITIONING DEVICE OF BARCODE PRINTER

(75) Inventors: Shang-Shih Kuo, Yonghe (TW); Chin-Chuan Liu, Taipei (TW)

(73) Assignee: TSC Auto ID Technology Co., Ltd., I-Lan Hsien (TW)

( * ) Notice: Subject to any disclaimer, the term of this patent is extended or adjusted under 35 U.S.C. 154(b) by 566 days.

(21) Appl. No.: 12/382,584

(22) Filed: Mar. 19, 2009

(65) Prior Publication Data

US 2009/0238630 A1 Sep. 24, 2009

(30) Foreign Application Priority Data

Mar. 24, 2008 (TW) ..... 97205010 U

(51) Int. Cl.
*B41J 15/04* (2006.01)

(52) U.S. Cl. ..... 400/619; 400/579

(58) Field of Classification Search ..... 400/613, 400/611, 120.16, 619; 242/578, 596
See application file for complete search history.

(56) References Cited

U.S. PATENT DOCUMENTS 6,622,622 B2 * 9/2003 Lee et al. ..... 101/228
6,695,500 B2 * 2/2004 Kim et al. ..... 400/613
7,270,111 B2 * 9/2007 Grybush et al. ..... 123/400
7,824,116 B2 * 11/2010 Lyman ..... 400/613

* cited by examiner

*Primary Examiner* — Seung Lee
*Assistant Examiner* — Christle Marshall
(74) *Attorney, Agent, or Firm* — Rosenberg, Klein & Lee

(57) ABSTRACT

A label roll positioning device is provided for a barcode printer and includes at least one slide rail, at least one positioning rail, and at least one pair of roll retainers. The slide rail and the positioning rail are arranged in a parallel manner inside a housing of the barcode printer. The positioning rail forms teeth on a surface thereof. At least one of the roll retainers has a bottom forming a mounting portion that is slidably fit and mounted to the slide rail for being slidable along the slide rail. The roll retainers are spaced to receive a roll of label therebetween in a securely held manner. The roll retainer is provided therein at least one positioning plug having an end forming a locking section. The positioning plug can be downward driven to have the locking section downward projecting out of the roll retainer, and the positioning plug can be upward driven to have the locking section back into concealment inside the roll retainer. Thus, with the roll of label received between the roll retainers, the positioning plug is downward driven and the locking section engages the teeth of the positioning rail to effect positioning and fixing for securely holding the roll of label between the roll retainers. A positioning device with movable and adjustable locking engagement can be realized.

2 Claims, 6 Drawing Sheets

LABEL ROLL POSITIONING DEVICE OF BARCODE PRINTER

BACKGROUND OF THE INVENTION

1. Field of the Invention

The present invention relates to a label roll positioning device of a barcode printer, and in particular to a label roll positioning device that is applicable to a barcode printer and features movable and releasable control of locking engagement to properly position roll retainers and a label roll.

2. The Related Arts

A conventional barcode printer includes a label roll to be printed retained inside the barcode printer for feeding a printable label to a printing mechanism for carrying out printing operations. The retention mechanism for the label roll of the barcode printer only functions to retain label roll of fixed diameter and length and is not capable to retain label rolls of different diameters and lengths. This is certainly adverse to the development of the barcode printer industry. Further, it is likely that the label roll cannot be securely retained in the barcode printer, which affects the printing quality of the barcode printer.

SUMMARY OF THE INVENTION

Apparently, the conventional label roll retaining mechanism of the barcode printer only works for label rolls of limited sizes or a single fixed size, which limits the industrial use of the barcode printer. Also, the conventional label roll retaining mechanism is not capable to securely retain and fix a roll of label inside a barcode printer, leading to problems of loosening of the label roll.

Thus, the present invention is aimed to provide a label roll positioning device for a barcode printer, wherein the label roll positioning device comprises at least one slide rail, at least one positioning rail, and at least one pair of roll retainers. The slide rail and the positioning rail are arranged in a parallel manner inside a housing of the barcode printer. The positioning rail forms teeth on a surface thereof. At least one of the roll retainers has a bottom forming a mounting portion that is slidably fit and mounted to the slide rail for being slidable along the slide rail. The roll retainers are spaced to receive a roll of label therebetween in a securely held manner. The roll retainer is provided therein at least one positioning plug having an end forming a locking section. The positioning plug can be downward driven to have the locking section downward projecting out of the roll retainer, and the positioning plug is selectively upward driven to have the locking section back into concealment inside the roll retainer. Thus, with the roll of label received between the roll retainers, the positioning plug is downward driven and the locking section engages the teeth of the positioning rail to effect positioning and fixing for securely holding the roll of label between the roll retainers. And, thus, a positioning device with movable and adjustable locking engagement can be realized.

The effectiveness of the label roll positioning device of the present invention is that a barcode printer equipped with such a label roll positioning device can accommodate label rolls of various diameters and lengths and further, the label roll can be securely retained in the barcode printer to ensure high quality of label printing.

BRIEF DESCRIPTION OF THE DRAWINGS

The present invention will be apparent to those skilled in the art by reading the following description of a preferred embodiment thereof, with reference to the attached drawings, wherein.

DETAILED DESCRIPTION OF THE PREFERRED EMBODIMENT

Figure 1:
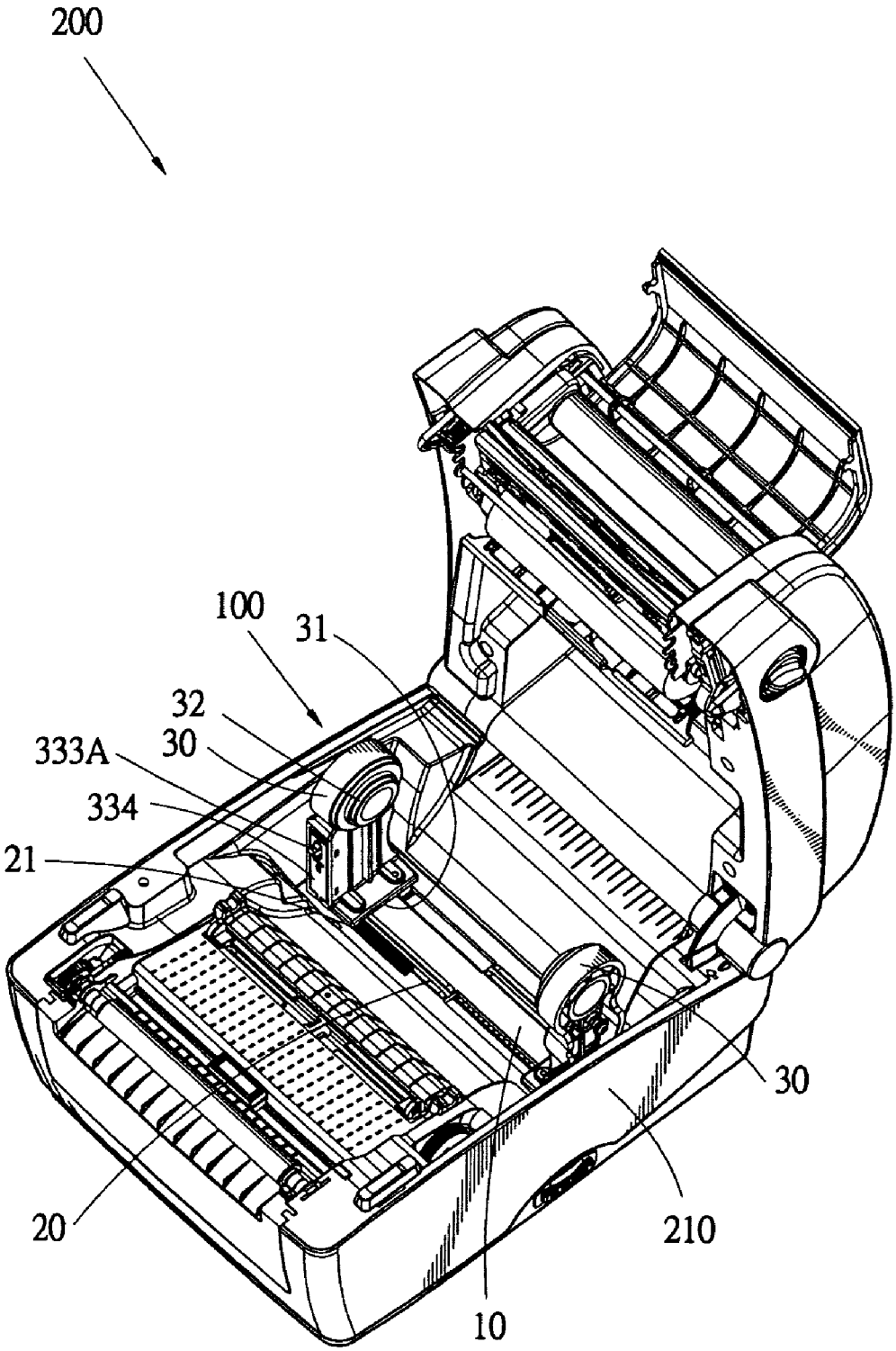
FIG. 1 is a perspective view showing a barcode printer in which a label roll positioning device constructed in accordance with the present invention is mounted.
Figure 2:
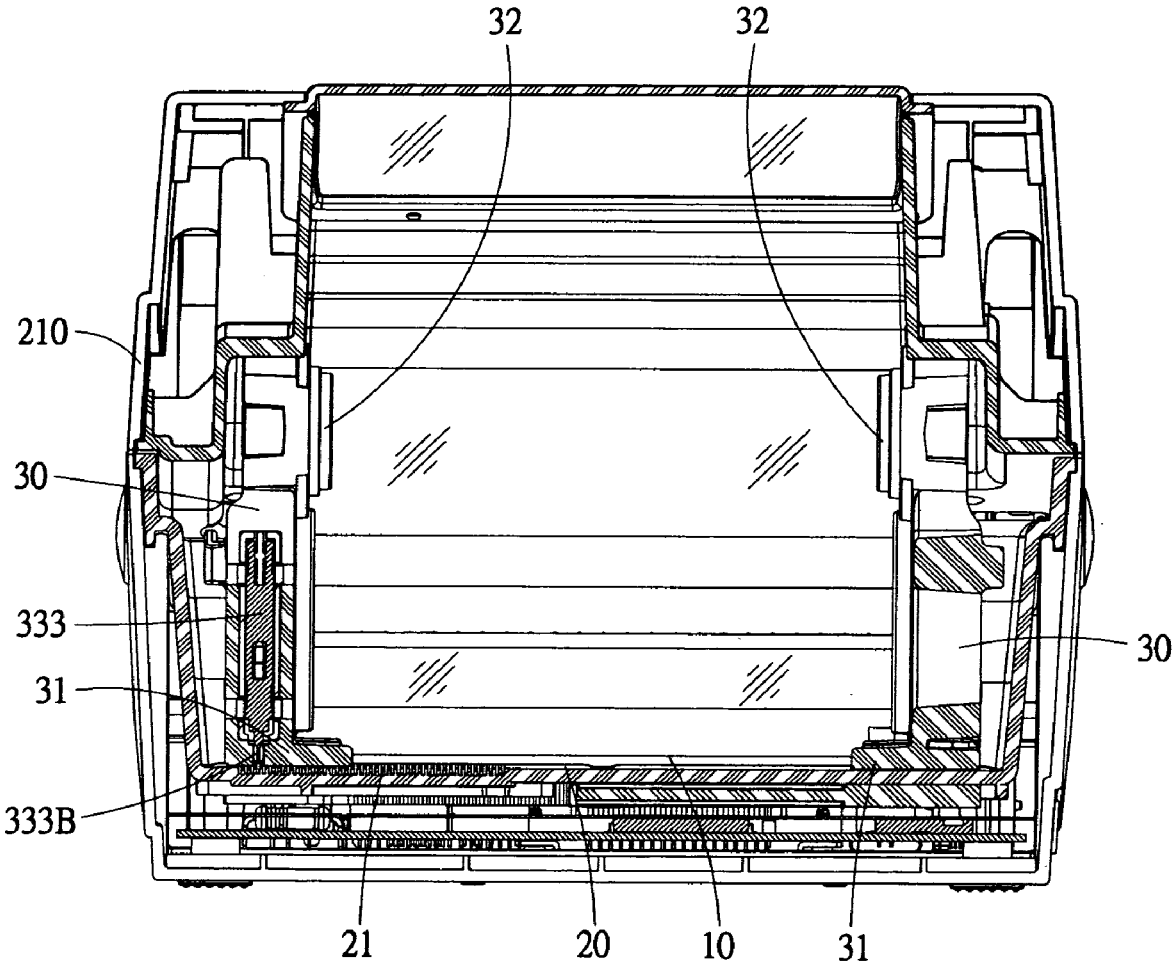
FIG. 2 is a front view of the barcode printer, illustrating a structural relationship among roll retainers, a slide rail, and a positioning rail of the label roll positioning device of the present invention.
Figure 3:
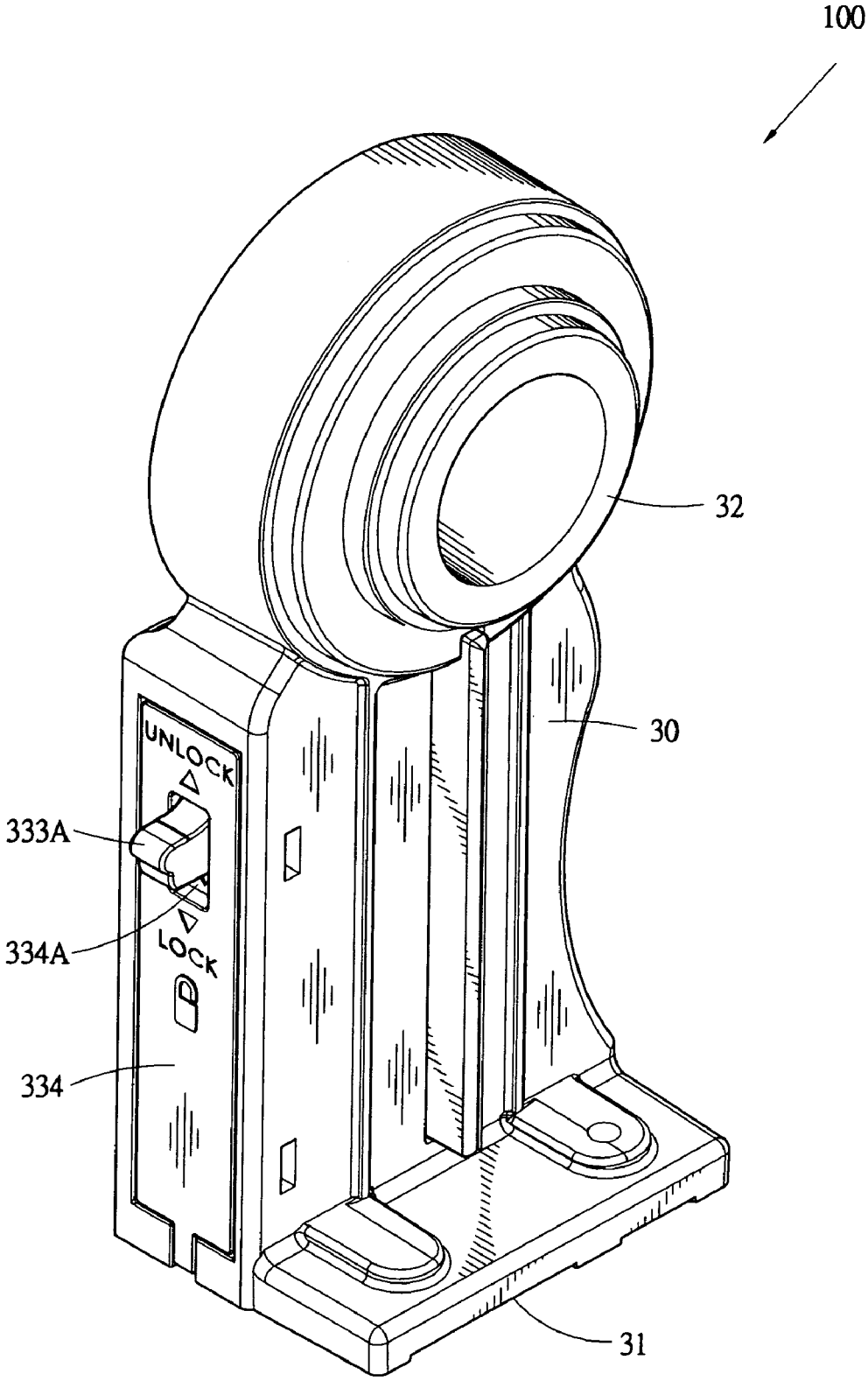
FIG. 3 is a perspective view of the label roll positioning device of the present invention.
Figure 4:
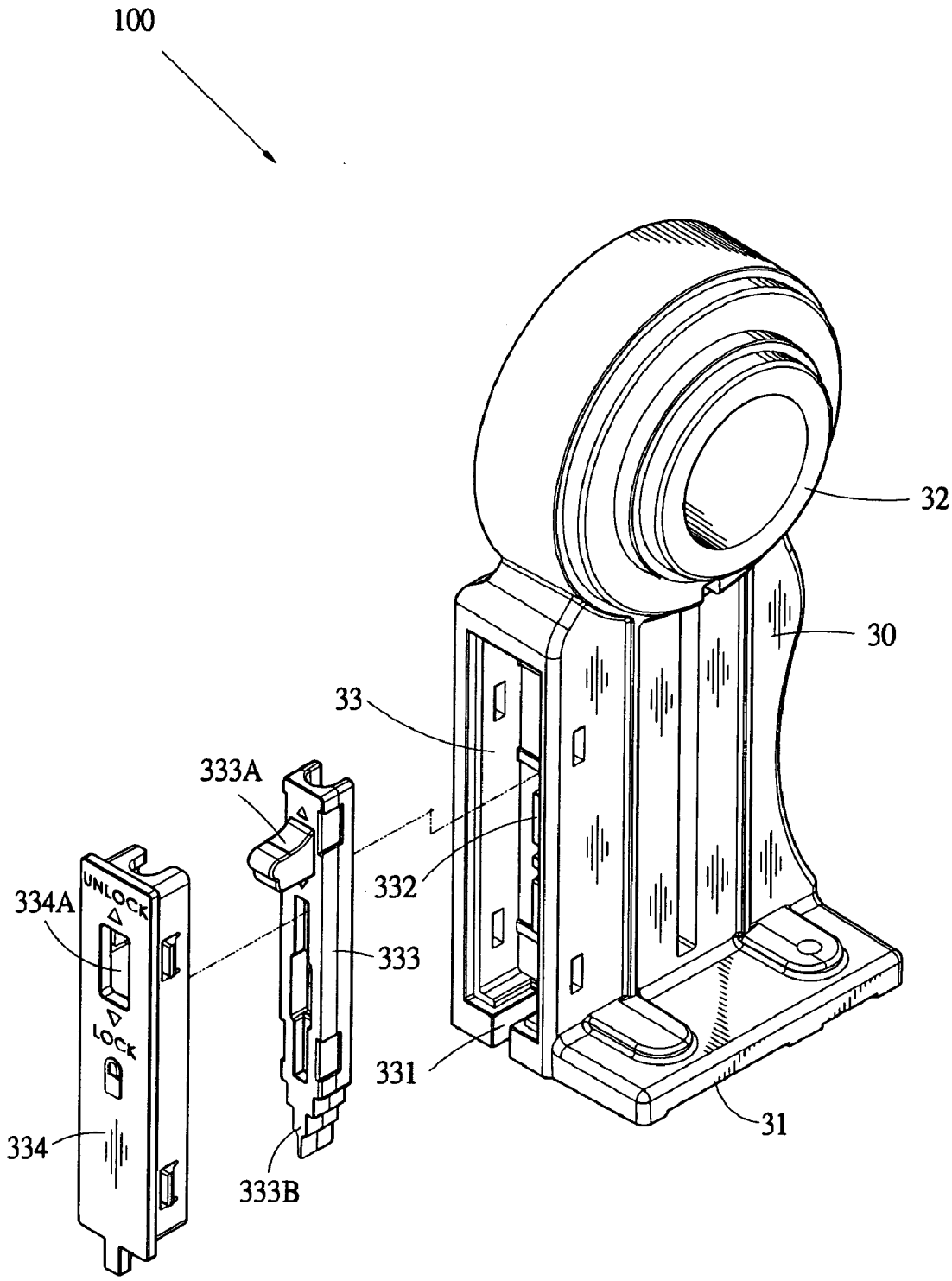
FIG. 4 is an exploded view of the label roll positioning device of the present invention.

With reference to the drawings and in particular to FIGS. 1-4, a label roll positioning device constructed in accordance with the present invention, generally designated at 100, is provided for a barcode printer, which is designated with reference numeral 200. The label roll positioning device 100 comprises at least one slide rail 10 and at least one positioning rail 20. The slide rail 10 and the positioning rail 20 are arranged inside a housing 210 of the barcode printer 200 in a parallel manner. The positioning rail 20 has a surface forming a series of teeth 21.

The label roll positioning device 100 further comprises at least one pair of roll retainers 30, preferably (but not necessarily) with each roll retainer associated with one sidle rail and one positioning rail. At least one of the roller retainers 30 has a bottom that forms a mounting portion 31 slidably fit and mounted to the slide rail 10 for being slidable along the slide rail 10. The roll retainers 30 have a top portion having an inside surface opposing each other and forming at least one rotation axle 32, whereby a label roll 300 (see FIGS. 5 and 6) can be received in a space between the roll retainers 30 with ends of the label roll 300 fit over the rotation axles 32 respectively.

One side surface of the roll retainer 30 forms at least one accommodation chamber 33 that is partly delimited by a lower wall in which a projection notch 331 is formed. The projection notch 331 corresponds in position to the teeth 21 of the positioning rail 20. A guide rail 332 is formed inside the accommodation chamber 33. A positioning plug 333 is received in the accommodation chamber 33 and is movably fit over the guide rail 332. An operation handle 333A is formed on one surface of the positioning plug 333 and a locking section 333B is formed on a lower end of the positioning plug 333. The positioning plug 333 can be operated by depressing down the operation handle 333A to have the locking section 333B projecting out of the projection notch 331, or the operation handle 333A of the positioning plug 333 can be pulled upward to withdraw the locking section 333B back into concealment within the accommodation chamber 33 of the roll retainer 30. The accommodation chamber 33 is also provided with a face panel 334, which selectively closes and seals the accommodation chamber 33. The face panel 334 forms an operation opening 334A through which the operation handle 333A of the positioning plug 333 projects out of the accommodation chamber 33.

Figure 5:
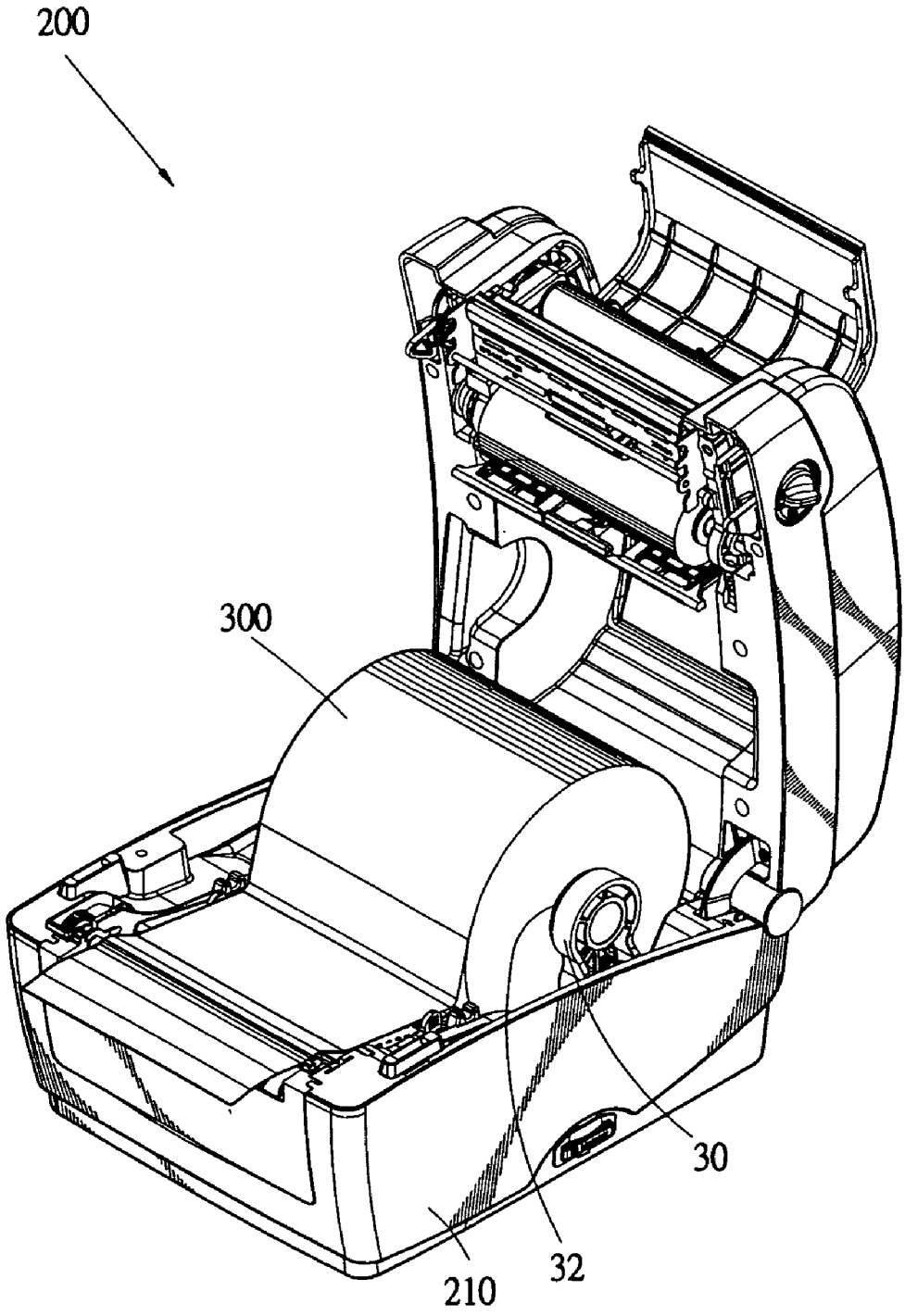
FIG. 5 is a perspective view illustrating a practical application of the label roll positioning device of the present invention in securely holding a roll of label in a barcode printer.
Figure 6:
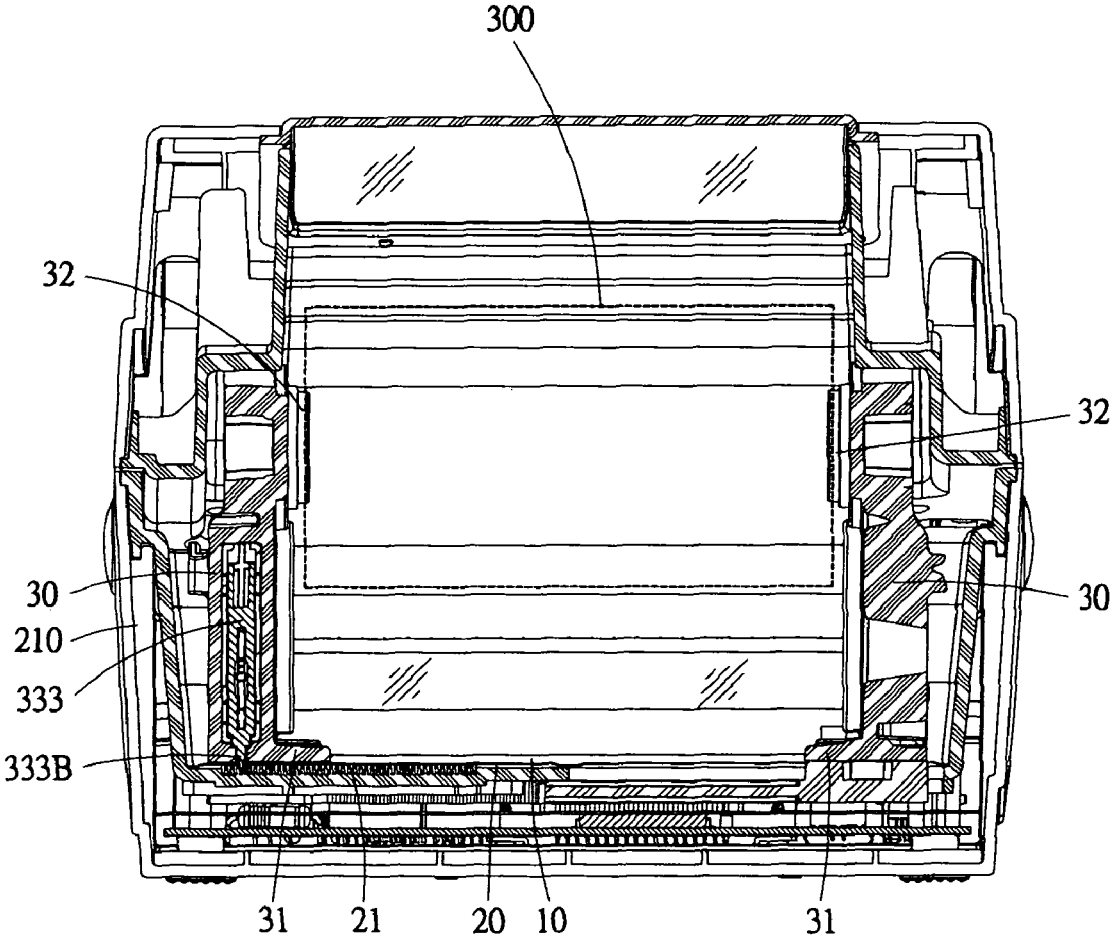
FIG. 6 is a front view of the barcode printer, illustrating engagement between a positioning plug of the roll retainer and teeth formed on the positioning rail.

Also referring to FIGS. 5 and 6, a practical application of the label roll positioning device 100 of the present invention is illustrated. The two roll retainers 30 are allowed to slide along the slide rail 10 to have the label roll 300 fit to and securely held by the rotation axles 32 of the roll retainers 30. The operation handles 333A of the positioning plugs 333 of the two roll retainers 30 are then depressed down to have the locking sections 333B projecting outward to engage the teeth 21 of the positioning rail 20 whereby the label roll 300 is securely held between the two roll retainers 30.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A label roll positioning device for a barcode printer comprising:

at least one slide rail and one positioning rail arranged in a parallel manner inside a housing of the barcode printer, the positioning rail having teeth formed on a surface thereof; and at least one pair of roll retainers, at least one of the roll retainers having a mounting portion disposed at a bottom portion thereof and slidably fit to the slide rail for being slidable along the slide rail, the roll retainers having top portions opposing each other and configured to receive a label roll therebetween, the at least one roll retainer having a longitudinally extended accommodation chamber that has a projection notch formed through a lower end thereof disposed in correspondence with the teeth of the positioning rail, the at least one roll retainer having a longitudinally extended guide rail formed inside the accommodation chamber, the at least one roll retainer including:

(a) positioning plug being received in the accommodation chamber and being longitudinally displaceable therein, the positioning plug having a U-shaped cross-sectional contour to define a longitudinally extended slotted opening therein, the longitudinally extended slotted opening of the positioning plug being fit over the guide rail, the positioning plug further having an operation handle extending laterally therefrom and a locking section formed at a longitudinal end thereof and disposed in correspondence with the projection notch; and (b) a face panel forming a closure for the accommodation chamber, the face panel having an operation opening formed therethrough and through which the operation handle of positioning plug extends and is longitudinally displaceable therein, whereby the positioning plug is reversibly longitudinally displaceable responsive to corresponding displacement of the operation handle within the operation opening to thereby selectively extend the locking section through the projection notch and engage the locking section with the teeth of the positioning rail for fixing the at least one roll retainer at a selected position.

2. The label roll positioning device as claimed in claim 1, wherein inside surfaces of the top portions of the roll retainers opposing each other are each formed with a rotation axle extending therefrom, each rotation axle having a stepped contour to accommodate label rolls of different diameters.

* * * * *